United States Patent [19]

Bower et al.

[11] Patent Number: 4,697,624

[45] Date of Patent: Oct. 6, 1987

[54] VAPOR RECOVERY NOZZLE

[75] Inventors: Allen M. Bower, Erie; Eric J. Butterfield, Fairview, both of Pa.; Robert D. Roberts, Jefferson, Ohio

[73] Assignee: Emco Wheaton, Inc., Conneaut, Ohio

[21] Appl. No.: 823,005

[22] Filed: Jan. 27, 1986

[51] Int. Cl.[4] ..... B67C 3/34; B65B 31/06

[52] U.S. Cl. ..... 141/208; 141/226; 141/97; 141/311 R; 141/392

[58] Field of Search ..... 141/97, 206–229, 141/37–59, 1–12, 392, 86, 285–310, 311 R

[56] References Cited

U.S. PATENT DOCUMENTS

| | | | |
|---|---|---|---|
| 4,018,252 | 4/1977 | Burtis et al. | 141/97 |
| 4,108,223 | 8/1978 | Hansel | 141/392 |
| 4,214,614 | 7/1980 | Pyle | 141/86 |

*Primary Examiner*—Houston S. Bell, Jr.

*Attorney, Agent, or Firm*—Pearne, Gordon, McCoy & Granger

[57] ABSTRACT

A vapor recovery nozzle is disclosed in which the main body of the nozzle has the vapor passage located above the fluid passage, so that the fluid valve is separated from the top of the nozzle by the vapor passage. Thus the valve may only be removed through the bottom of the nozzle by removing the trigger mechanism and removing the vacuum tripping mechanism which is also connected to the trigger mechanism. Removal of the tripping mechanism is also made easily determinable by the use of a soft aluminum seal over the top opening of the trigger mechanism. The tripping mechanism is responsive to displacement of the vapor recovery shroud to prevent dispensing fuel unless the nozzle is in the fill tank. Other improvements to prior art vapor recovery nozzles include an improved trigger mechanism having a camming surface to engage the stem of the main valve.

17 Claims, 7 Drawing Figures

VAPOR RECOVERY NOZZLE

BACKGROUND OF THE INVENTION

1. Field of the Invention

This invention relates to automatic fuel dispensing nozzles, and in particular to automatic nozzles for filling automobile gasoline tanks in which the vapor displaced during the filling operation is recovered.

2. Description of the Prior Art

In order to reduce atmospheric polution and to conserve energy, vapor which is displaced from an automobile gasoline tank during filling at a filling station is often recovered. The displaced vapor is typically recovered through passages formed in the body of the gasoline dispensing nozzles. Examples of prior art vapor recovery nozzles are shown in U.S. Pat. No. 3,974,865, issued to Fenton et al.; U.S. Pat. No. 3,982,571, issued to Fenton et al.; U.S. Pat. No. 4,060,110, issued to Bower; and U.S. Pat. No. 4,143,689, issued to Conley et al. However, there have been various difficulties in the design of previous vapor recovery nozzles.

One difficulty relates to the position of the vapor passage in the body of the nozzle whereby condensate in the vapor passage tends to stay in the nozzle or to drain down into the hose. If the condensate accumulates at a low point in the hose, it may block the vapor passage and thus defeat the purpose of the vapor recovery system.

Another problem with prior art vapor recovery nozzles relates to the ease with which such nozzles may be disassembled and modified. Vapor recovery nozzles are usually inspected and certified by appropriate private and public agencies, such as Underwriters Laboratories, Inc. and state air pollution control boards. These inspections and certifications were intended to certify that the nozzles as originally manufactured meet all necessary requirements in order to function properly. However, the nozzles frequently have been disassembled and modified by the operator or by other individuals. The prior art vapor recovery nozzles have been relatively simple to disassemble because the valve stem could be easily removed from the nozzle and the tripping mechanism could also be easily removed and modified or replaced with inferior parts. Thus, prior art nozzles were not tamperproof, and, as a result, the nozzles were frequently modified so that they no longer performed in accordance with the standards originally met for private and public certification. When reassembled after such modifications, it was virtually impossible to tell that modifications had taken place and that the nozzles no longer met the standards as originally manufactured.

Another problem with gasoline dispensing nozzles in general, and vapor recovery nozzles in particular, relates to a reliable mechanism for stopping the flow of liquid from the nozzle if the nozzle is removed from the fill tank. If the nozzle inadvertently falls out of the fill tube or if the nozzle trigger is inadvertently actuated while the nozzle is not in the tank, fuel can squirt from the nozzle creating a dangerous condition. Prior art mechanisms which were designed to prevent this occurrence such as those mechanisms disclosed in U.S. Pat. No. 4,331,187 and No. 4,343,336, both issued to Trygg, have relied upon modifications to the vacuum tripping mechanism and have permitted some amount of fuel to squirt from the nozzle before the mechanism actuated.

A similar problem is unique to for vapor recovery nozzles. In order for the vapor recovery process to work reliably, it is important that a good seal be made between the vapor recovery shroud and the opening of the fill tank. If the nozzle is barely inserted into the fill tank, the fuel dispensing operation will continue as normal, but the vapor recovery operation will be frustrated because vapor will escape before it enters the vapor recovery shroud. It is important, therefore, that the nozzle be fully inserted into the fill tank before fuel is dispensed.

Another problem with prior art nozzle designs related to the design of the trigger mechanism. The triggers for gasoline dispensing nozzles relied upon an attachment to a tripping mechanism to provide the fulcrum for the trigger. The trigger then engaged the valve stem to open and close the dispensing valve as long as the tripping mechanism did not sense that the gasoline tank was full. This trigger mechanism was relatively difficult to design and involved very close tolerances. In addition, the pivoting action of the trigger on the tripping mechanism produced side forces on the valve stem, and these side forces could bind the valve stem and prevent it from operating under certain circumstances.

While the prior art vapor recovery nozzles have included many improvements over their predecessors, they still had many design features which were not optimum.

SUMMARY OF THE INVENTION

The disadvantages of the prior art recovery nozzles are overcome by the vapor recovery nozzle of the present invention. With the present invention, the vapor passage is located above the fuel passage in the main body portion of the nozzle. This design is more conductive to the natural drain pattern of the vapor line. Condensate in the vapor passage is able to drain out of the nozzle more easily without being trapped in the main body portion of the nozzle or draining into the hose where it could block the vapor passage. The location of the vapor passage in the top of the main body portion of the nozzle also results in a lower pressure drop along the vapor recovery line because there are fewer contortions in the line which cause pressure drops. This lower pressure drop results in more efficient vapor recovery.

In addition, the placement of the vapor passage above the fuel passage in the main body portion of the nozzle results in a design in which the ability to inspect any tampering with the nozzle is increased. The main valve in the fuel passage is no longer accessible from the top of the nozzle because of the placement of the vapor passage above the fuel passage. With the present invention, the main valve is only removable through the bottom of the main body portion adjacent to the trigger. Therefore, the trigger must be removed in order to gain access to the main valve, and in order to remove the trigger, the tripping mechanism must also be removed. With the present invention, the tripping mechanism is sealed in place using a soft aluminum seal so that any tampering with the tripping mechanism or with the main valve or with the trigger requires removal of the seal. If the seal is removed or tampered with, it is readily visible from the top of the nozzle, and therefore it is easy upon cursory inspection to determine whether the nozzle has been tampered with or rebuilt. Thus, any modifications to the nozzle, which would result in its possible decertification by the appropriate certifying agency, can be easily detected by inspection of the seal on the top of the nozzle through which the tripping mechanism is removed.

Furthermore, the nozzle of the present invention has a unique interlock mechanism to prevent discharge of fuel from the nozzle unless the nozzle is fully inserted into the fill tank. The interlock mechanism includes a mechanical link between the vapor recovery shroud and the tripping mechanism, so that the main valve is not enabled unless the shroud is retracted, and the tripping mechanism is actuated if the shroud returns to its extended position. This interlock mechanism prevents fuel from squirting out of the nozzle if the trigger is inadvertently depressed or if the nozzle falls out of the fill tank. The interlock mechanism also prevents the nozzle from operating after the nozzle is replaced on the pump housing with the trigger locked. Unlike prior art mechanisms which permitted some fuel to squirt out of the nozzle before the mechanism took over and stopped the flow, the interlock mechanism of the the nozzle of the present invention requires that the nozzle must be fully inserted in the fuel tank before the main valve is enabled. Since a mechanical link is used which is based on the position of the vapor recovery shroud and not upon the flow of fluid through the nozzle, it is not necessary to allow a small amount of fluid to flow through the nozzle before the mechanism actuates.

The interlock mechanism of the nozzle of the present invention also assures that the nozzle is inserted far enough into the fill tank to provide the best possible seal for the vapor recovery operation. If the nozzle is not inserted far enough into the fill tank, and the vapor recovery shroud is not retracted, the interlock mechanism prevents the flow of liquid into the tank.

The nozzle of the present invention also uses an improved trigger design which increases the tolerances possible in the manufacture of the components of the trigger and reduces the possibility of undesirable side forces being applied to the valve stem. The trigger of the nozzle of the present invention includes a cam or fulcrum on a portion of the trigger which engages the bottom of the stem of the main valve. As the trigger is moved, the contact with the valve stem operates in the axial direction, and non-axial forces on the valve stem which would tend to result in the valve being bound up are avoided.

These and other advantages are achieved by the vapor revovery nozzle of the present invention. The nozzle comprises a main body portion for connection to a hose. The main body portion has a trigger mechanism at its lower portion for controlling a flow of fluid. A fluid discharge tube projects outwardy from the main body portion for dispensing fluid into a tank. A shroud assembly surrounds the discharge tube for containing a flow of vapor from the tank. The main body portion has a first passage from the flow of fluid from the hose to the discharge tube and a second passage located above the first passage for the flow of vapor from the shroud assembly to the hose.

In accordance with other aspects of the present invention, there is a fluid valve located in the first passage, and this valve is separated from the top of the main body portion by the second passage. The valve is removable from the main body portion only in the direction toward the trigger.

Also in accordance with another aspect of the invention, the nozzle comprises a main body portion for connection to a hose. The main body portion has a trigger mechanism for controlling a flow of fluid. A fluid discharge tube projects outwardly from the main body portion for dispensing fluid into a tank. A shroud assembly surrounds the fluid discharge tube for containing a flow of vapor from the tank. At least a portion of the shroud assembly is displaceable with respect to the discharge tube. Means are connected to the shroud assembly for sensing the displacement of a portion of the shroud assembly. A tripping mechanism is connected to the trigger mechanism for making the trigger mechanism inoperative when the tripping mechanism is actuated. Means connect the tripping mechanism to the sensing means for actuating the tripping mechanism when a portion of the shroud assembly is displaced.

DETAILED DESCRIPTION OF THE PREFERRED EMBODIMENT

Figure 1:
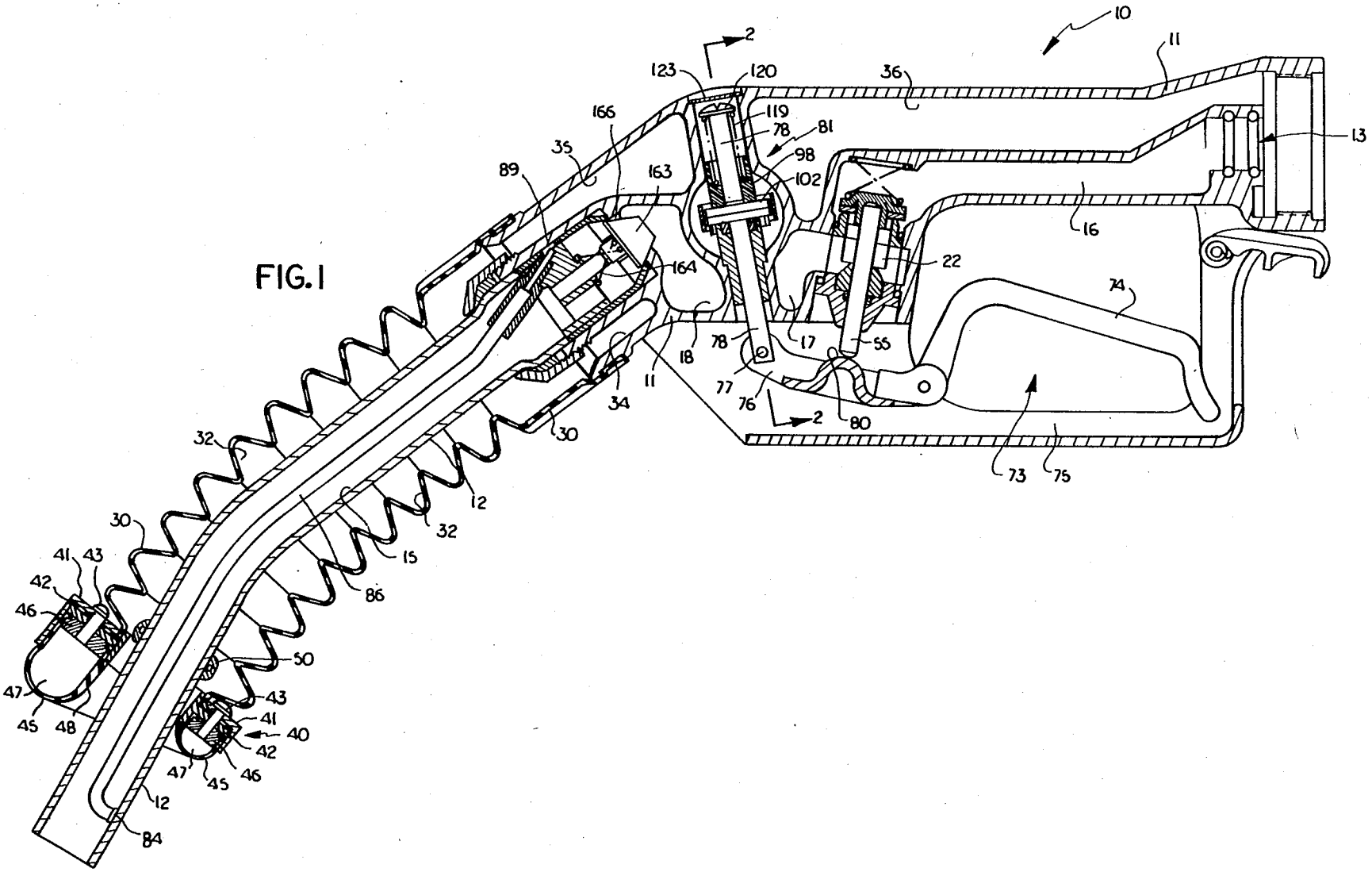
FIG. 1 is a side sectional view of the nozzle of the present invention.

Referring more particularly to the drawings, and initially to FIG. 1, there is a shown a vapor recovery nozzle 10 according to the present invention. The nozzle comprises a main body portion 11 having a fluid discharge tube 12 extending from one end of the main body portion. The main body portion 11 has a fitting 13 for connection to a hose (not shown). The main body portion 11 also has a fluid passage extending through it for the flow of fluid from the hose to a fluid discharge passage 15 in the fluid discharge tube 12. This fluid passage comprises a main fluid passage 16 located in the main body portion 11 and connecting with the fitting 13, a fluid passage 17, and a fluid passage 18. The fluid passage 17 is connected to the fluid passage 18 by passages 19 and 20 shown in FIG. 2. A main valve 22 is located between the fluid passage 16 and the fluid passage 17 for opening and closing to regulate the flow of fluid through the nozzle.

A vapor recovery shroud 30 extends from the end of the main body portion 11 opposite the fitting 13. The shroud 30 extends around the fluid discharge tube 12 to form an annular vapor recovery passage 32. The main body portion 11 has a vapor passage extending therethrough which communicates with the vapor recovery passage 32 in the shroud 30. This vapor passage comprises an annular vapor passage 34 and 35 located adjacent to the connection of the shroud 30 and a main vapor passage 36 located in the main body portion 11 directly above the main fluid passage 16. The annular vapor passage 35 connects with the main vapor passage 36 through a passage 37 shown in FIG. 2. The main vapor passage 36 communicates with the hose fitting 13. The hose (not shown) which connects with the fitting 13 contains dual passages, one for the dispensing fluid which communicates with the fluid passage 16 and one for the return vapor which communicates with the vapor passage 36.

The vapor recovery shroud 30 has an annular sealing ring assembly 40 at the outer end thereof. The sealing ring assembly 40 consists of a backing plate 41 and inner member 42. The outer end of the shroud 30 fits between the backing plate 41 and the inner member 42 and is held in place by a plurality of screws 43 which connect the plate 41 to the member 42. The screws 43 also hold a soft annular sealing member 45. The annular sealing member 45 has a central inner opening through which the discharge tube 12 extends. Sealing member 45 is asymmetrical with the upper portion of the sealing member 45 extending outwardly a greater distance than the lower part of the sealing member 45. The sealing member 45 is attached by means of a ring 46 located adjacent to the inner member 42 which is also connected by the screws 43. The sealing member 45 thus includes an annular air pocket 47 which provides a soft cushion to the sealing member. In addition, the inner wall of the sealing member 45 designated at 48 is increased in thickness so that this portion of the sealing member is relatively rigid and resists deformation. This assures that the upper portion of the sealing member 45 which extends outwardly a greater distance than the lower portion will have increased rigidity to prevent deformation as it engages the outer rim of the fuel tank.

The sealing ring assembly 40 is capable of sliding along the outside of the fluid discharge tube 12. As the sealing member 45 engages the rim of the fuel tank, the sealing ring assembly 40 is pushed up along the fluid discharge tube 12 toward the main body portion 11 of the nozzle. The vapor recovery shroud 30 is formed with bellows which can be compressed as the sealing ring assembly 40 moves along the tube 12.

Figure 4:
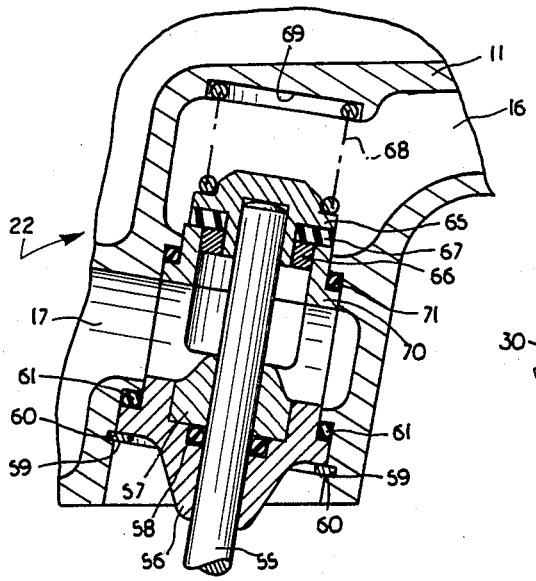
FIG. 4 is a detailed side sectional view of the main valve as shown in FIG. 1 to a larger scale.

The flow of fluid through the nozzle is controlled by the main valve 22 which is shown in greater detail in FIG. 4. The main valve 22 has a valve stem 55 which is slidably mounted in a bushing comprising members 56 and 57 located at the bottom of the main body portion 11 of the nozzle. An O-ring 58 between the members 56 and 57 seals the opening in the fluid passage 17 through which the valve stem 55 extends. The bushing member 56 is held in place by a retaining ring 59 positioned in a groove 60 in the main body portion 11. An O-ring 61 seals between the bushing member 56 and the opening in the main body portion 11.

A cap 65 fits over the top of the valve stem 55 and a collar 66 is mounted around the cap. A sealing ring 67 is positioned between the cap 65 and the collar 66. The cap 65 is biased downwardly by a spring 68 which extends between the cap 65 and a recess 69 formed in the upper wall of the main fluid passage 16. The spring 68 forces the valve stem 55 downwardly and forces the sealing ring 67 into contact with an annular valve seat 70 located around the opening between fluid passages 16 and 17. An O-ring 71 is provided between the valve seat 70 and the opening in the main body portion 11 between the fluid passages 16 and 17. As the valve stem 55 is moved upwardly, it compresses the spring 68 and allows sealing ring 67 to disengage from the valve seat 70 to open the opening between the fluid passages 16 and 17 to permit fluid to flow through the nozzle.

The entire assembly of the main valve 22 is removable through the bottom of the main body portion 11. By removing the retaining ring 59, the entire assembly can be removed, including the bushing members 56 and 57 and the valve seat 70. The removability of the valve seat 70 permits the seat to be changed if it becomes worn or damaged. This contrasts with prior art nozzles in which the valve seat was machined into the nozzle body.

To actuate the main valve 22, the valve stem 55 is pushed upwardly by a trigger mechanism 73 located at the bottom of the main body portion 11 of the nozzle, as shown in FIG. 1. The trigger mechanism 73 comprises a lever or handle portion 74 which is retained on each side by a trigger mounting extension 75 which extends downwardly from the main body portion 11 of the nozzle. One end of the handle portion 74 of the trigger mechanism is pivotally attached to an engaging link 76 of the trigger mechanism 73. The engaging link 76 is pivotally attached at one end to the handle portion 74 and is pivotally attached at the other end by a pin 77 to a slide stem 78 which is part of a tripping mechanism 81. The engaging link 76 includes an upwardly extending cam 80 which engages the bottom end of the valve stem 55.

In operation of the trigger mechanism 73, the operator grasps the handle portion 74 and squeezes it to pull the handle portion upwardly. The handle portion 74 pivots about its connection to the engaging link 76 and pulls the engaging link upwardly. As the engaging link 76 pivots upwardly, the cam 80 which is in engagement with the valve stem 55 forces the valve stem upwardly to open the main valve 22. This allows fluid to flow through the nozzle and permits fluid to be dispensed. Fluid continues to be dispensed as long as the trigger mechanism 73 is squeezed by the operator and as long as the slide stem 78 which is connected to one end of the engaging link 76 by the pin 77 provides a firm pivot point for the forward end of the trigger mechanism. When the tripping mechanism 81 permits the slide stem 78 to be moved downwardly, it no longer provides a fixed pivot point for the engaging link 76. If the handle portion 74 is moved upwardly, the slide stem 78 is pulled downwardly, and it will not provide sufficient force to permit the trigger mechanism to push the valve stem 55 upwardly to open the main valve 20. In this manner, the tripping mechanism 81 prevents engagement of the main valve 22.

Thus when the slide stem 78 is retained in the position shown in FIG. 1, it provides a fixed pivot point for the forward end of the trigger mechanism 73, and upward movement of the handle portion 74 is operable to move the valve stem 55 upwardly to open the main valve 22 and to permit fluid to flow through the fluid passage. The slide stem 78 is released from the position shown in FIG. 1 in response to the level of liquid in the tank rising above the predetermined point at the lower end of the fluid discharge tube 12, or in response to excess pressure in the vapor passage, or in response to removal of the nozzle from the fill tank and the resultant extension of the vapor recovery shroud 30.

Figure 2:
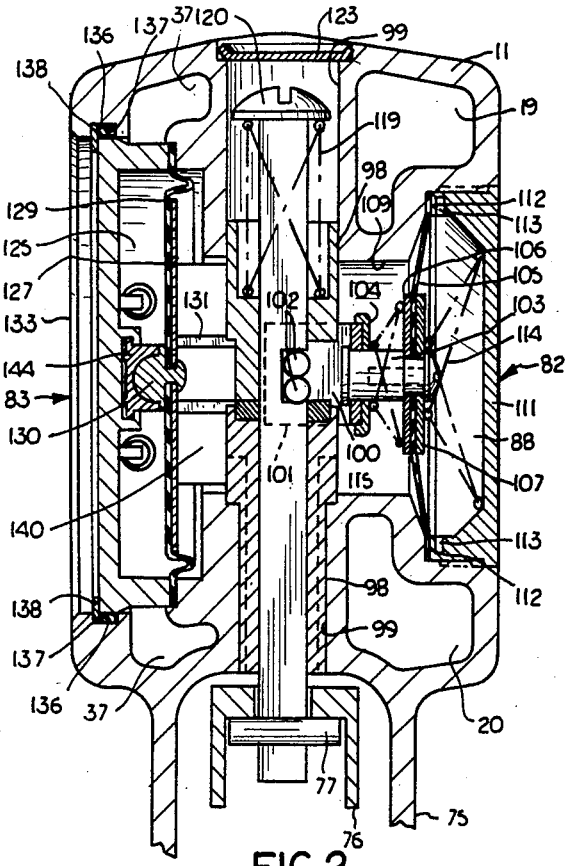
FIG. 2 is an end sectional view of the tripping mechanism taken along line 2—2 of FIG. 1.

With reference to FIG. 2, the tripping mechanism 81 comprises a first actuator mechanism 82 which is vacuum operated and senses when the level of gasoline in the tank being filled exceeds a certain level, and a second actuator mechanism 83 which is pressure operated and senses when the pressure of the vapor in the vapor passage exceeds a certain level and which is responsive to movement of the vapor recovery shroud 30.

The first actuator mechanism 82 includes a vacuum vent opening 84 (FIG. 1) located at the end of the fluid discharge tube 12. The opening 84 is connected to a vacuum vent passage 86 which extends along the inside of the fluid discharge tube 12. The inner end of the vacuum vent passage 86 is connected to a vacuum chamber 88 (FIG. 2) by means of a passage 89 (FIG. 1). In addition, another passage (not shown) connects the passage 89 with the chamber 88.

Figure 3:
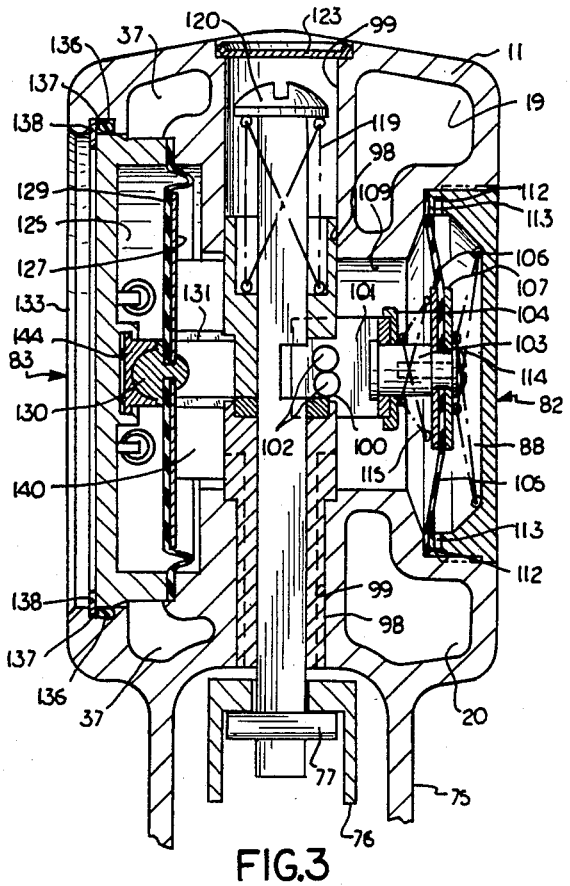
FIG. 3 is an end sectional view of the tripping mechanism similar to FIG. 2 showing the vacuum tripping mechanism in its actuated position.

With reference to FIGS. 2 and 3, the first actuator mechanism 82 also includes a fixed tubular guide sleeve 98 located within a passage 99 which extends vertically through the main body portion 11 of the nozzle. The sleeve 98 is formed with a U-shaped slot 100 opening inwardly from one face of the sleeve. A small clevis 101 extends perpendicularly to the sleeve 98 and has slots formed on each side to receive the ends of latching rollers 102. The latching rollers 102 are mounted within the clevis 101 for movement with the clevis into and out of engagement with the U-shaped slot 100 in the sleeve 98. The end of the clevis 101 is connected to an annular hub 103. A shoulder pin 104 fits around the clevis 101 and retains the latching rollers 102 in place. A diaphragm 105 has a central opening through which the hub 103 extends. The diaphragm 105 is attached to the hub 103 by means of two washers 106 and 107 which fit around the hub on either side of the diaphragm. The washers 107 and 108 and the diaphragm 105 are held in place by a screw 108 which is inserted into the end of the hub 103.

The diaphragm 105 separates the vacuum chamber 88 from the chamber 109 in which the clevis 101 is mounted. The vacuum chamber 88 is closed by means of a cap 111 which covers the opening in the main body portion 11 of the nozzle which forms the chamber 88. The rim of the diaphragm 105 is secured between the cap 111 and the periphery of the main body portion 11 forming the vacuum chamber 88 by a clamp ring 112. The cap 111 is sealed by means of an O-ring 113. A spring 114 is positioned between the washer 107 and the cap 111 to urge the clevis 101 inwardly toward the fixed sleeve 98. As the clevis 101 is urged inwardly, the diaphragm 105 is urged into a position as shown in FIG. 2. A second spring 115 is positioned between the washer 107 and the shoulder pin 104 to prevent the first spring 114 from forcing the diaphragm 105 off the hub 103.

The slide stem 78 is slidably mounted within the fixed tubular guide sleeve 98. A coil spring 119 extends between the underside of the head of a screw 120 which is mounted at the upper end of the slide member 78 and the upper end of the fixed sleeve 98. The top of the passage 99 is closed by a soft aluminum seal 123. The passage 99 is thus factory sealed and cannot be opened without leaving evidence of tampering with the seal.

The second actuator mechanism 83 is located on the opposite side of the passage 99 from the first actuator mechanism 82. The second actuator mechanism 83 includes a vapor chamber 125 located opposite the vacuum chamber 88. A disc-shaped member 127 positioned against a diaphragm 129 is located within the vapor chamber 125. The diaphragm 129 is attached to the disc-shaped member 127 by means of a cam follower 130 which is mounted in adjacent openings in the center of both members. The disc-shaped member 127 has an extending actuator portion 131 which extends into the passage 99 and engages the rollers 102. The vapor chamber 125 is closed by a cap 133. The outer rim of the cap 133 engages the periphery of the diaphragm 129 to hold it in place against the main body portion 11 of the nozzle. A vent passage 135 is provided in the rim of the plug 133 to provide communication to the vapor passage 37. The cap 133 is sealed by an O-ring 136 positioned in a groove 137 in the main body portion 11. A retaining ring 138 holds the cap 133 and the O-ring 136 in place. The retaining ring 138 is positioned in the groove 137 along with the O-ring 136. This eliminates the need of providing a separate groove for the O-ring and for the retaining ring, and simplifies the manufacture and assembly of the nozzle.

The vapor in the vapor recovery line communicates with the vapor chamber 125 by way of the vent passage 135 from the vapor passage 37. The chamber 140 opposite the chamber 125 from the diaphragm 129 is open to atmosphere.

Figure 5:
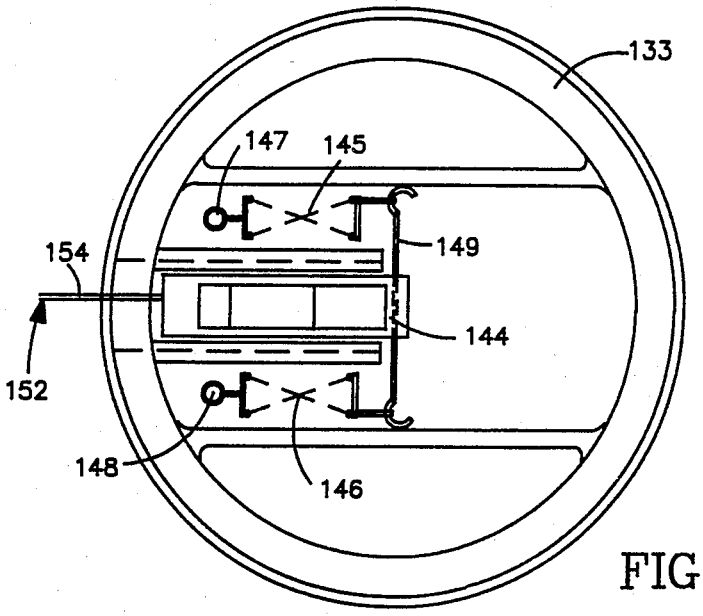
FIG. 5 is a side sectional view of the vapor chamber taken along line 6—6 of FIG. 3.

The cam follower 130 which is attached to the diaphragm 129 engages a slide cam 144 which is movably attached to the inside of the cap 133. As shown in FIG. 5, the slide cam 144 is retained in a resting position toward the discharge end of the nozzle by a pair of springs 145 and 146. One end of each of the springs 145 and 146 is mounted on one of a pair of posts 147 and 148 extending on the inside of the cap 133 on each side of the slide cam 144. The other end of each of the springs 145 and 146 is connected to the slide cam by a wire link 149. The springs 145 and 146 together pull the slide cam toward the discharge end of the nozzle (toward the left in FIG. 5).

Figure 6:
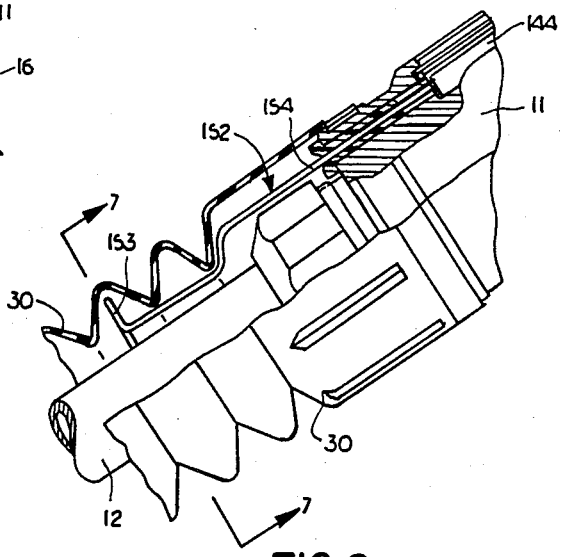
FIG. 6 is a detailed side section view of a portion of the nozzle of FIG. 1 showing the push rod.

The slide cam 144 is moved in opposition to the springs 145 and 146 by a push rod 152. As shown in FIG. 6, the push rod 152 has a circular portion 153 at one end which is located in one of the bellows of the vapor recovery shroud 30. The push rod 152 also has an actuating portion 154 on the other end which extends through an opening in the end of the main body portion 11 and into the vapor chamber 125 where it engages the end of the slide cam 144.

When the sealing rim assembly 40 is pushed up along the fluid discharge tube 12 toward the main body portion 11, the bellows of the shroud 30 are compressed toward the main body portion, and the push rod 152 is moved toward the end of the main body portion having the fitting 13. The movement of the push rod 152 causes the slide cam 144 to move in the same direction against the springs 145 and 146. When the slide cam 144 has been moved to the position in which the springs 145 and 146 are extended, the cam follower 130 can move toward the cam slide 144. When the sealing rim assembly 40 returns to its resting position, the bellows of the shroud 30 re-open allowing the push rod 152 to move toward the discharge end of the tube 12. The movement of the push rod 152 allows the slide cam 144 to return to its resting position as urged by springs 145 and 146, in which the slide cam 144 pushes the cam follower 130 toward the square stem 78.

Figure 7:
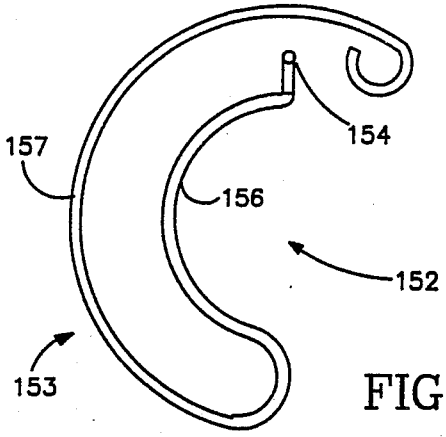
FIG. 7 is an end sectional view of the push rod taken along line 7—7 of FIG. 6.

As shown in FIG. 7, the circular portion 153 of the push rod 152 includes an inner circular portion 156 and an outer circular portion 157. The inner circular portion 156 is connected to the actuating portion 154. The outer circular portion 157 is engaged by the vapor recovery shroud 30 and is moved when the bellows of the shroud are compressed or expanded. The push rod 152 is formed of wire stock, and there is a spring effect between the outer circular portion 157 and the actuating portion 154. This allows for the shroud 30 to be fully retracted and for the bellows of the shroud to be fully compressed without forcing the actuating portion 154 of the push rod too far into the main body portion 11.

The first actuator mechanism 82 operates essentially the same as that disclosed in U.S. Pat. No. 3,196,908. A restrictor plug 163 (FIG. 1) is biased upwardly toward the main body portion 11 by means of a spring 164. When the main valve 22 is opened, fluid within the main body portion 11 is placed under pressure, and this pressure acting upon the restrictor plug 163 will force the restrictor plug against the bias of the spring 164 and will permit the pressurized fluid to flow from the passage 18 to the fluid discharge tube 12. As the flow rate increases, the restrictor 163 will move further against the spring 164, thus increasing the flow area between the restrictor plug 163 and the seat ring. This area increases in accordance with the configuration of the restrictor plug and varies, generally, as the rate of flow through the fluid passage. By controlling the flow area so that it corresponds to the rate of flow through the fluid passage, the flow area is always maintained full of liquid, and thus conditions are created in the throat of a venturi, and maintained in the throat leading to the establishment of a high degree of suction in a venturi throat at all flow rates. This venturi throat is formed in the region of the annular space 166 at the end of the annular vacuum vent passage 89 around the plug 163. The restrictor plug 163, however, offers no substantial restriction to fluid flow through the valve body to the extent of excessive pressure is required to maintain high flow rates.

The suction created in the throat 166 of the venturi is normally vented through the connection of the venturi with the vacuum vent opening 84 through the vacuum vent passage 86 and the vacuum vent passages 89 and 90. Thus, the vacuum chamber 88 is normally vented to the atmosphere through this passageway and the diaphragm 108 remains in the position shown in FIG. 2 as long as the vacuum vent opening 84 is not blocked.

As long as the tripping mechanism is not actuated, the spring 119 draws the slide stem 78 upwardly into a position in which the slot 100 is aligned with the slot in the fixed guide sleeve 98, and the spring 111 forces the latching rollers 102 into the slot 100 to retain the slide stem 78 in the position shown in FIG. 2 of the drawings. The trigger mechanism 73 (FIG. 1) may thus be manually engaged and moved to open the main valve 22. The slide stem 78 is fixedly held in place by engagement of the latching rollers 102 in the slot 100 providing a fixed pivot point for the engaging link 76 of the trigger mechanism. By squeezing the handle portion 74, the user forces the cam 80 into engagement with the valve stem 55 of the main valve 22 to open the valve and permit fluid to flow through the fluid passages and out the fluid discharge tube 12.

The tripping of the first actuator mechanism 82 occurs when the vacuum vent opening 84 is closed as the fluid in the tank being filled exceeds the level of the opening 84. When this occurs, the vacuum at the venturi throat 166 is no longer vented, and a vacuum is created in the chamber 88, pulling the diaphragm 105 to the right as shown in FIG. 3. As the diaphragm 105 moves, it pulls the clevis 101 attached to the diaphragm, and the latching rollers 102 are moved out of engagement with the slot 100. With the latching rollers 102 removed from the slot 100, the slide stem 78 is free to move within the fixed guide sleeve 98.

The flow of fluid from the nozzle also causes a displacement of vapor in the tank which is being filled, and the vapor is discharged from the tank through the vapor recovery passage 32 within the shroud 30 and through the vapor passages 34, 35, 36 and 37 in the main body portion 11 of the nozzle. As long as the pressure of the vapor in the vapor recovery passage is below a predetermined minimum, the spring 114 forces the actuator 131 and the attached diaphragm 129 away from the slide stem 78 and filling of the liquid continues. If the pressure in the vapor recovery passages rises above a predetermined minimum, generally about 8 to 12 inches of water, the pressure increase is transmitted to the chamber 125 which is connected to the passage 37 through the vent passage 135. The pressure increase in the chamber 125 causes the diaphragm 129 to be forced away from the cap 133 and toward the slide stem 78 (toward the right as shown in FIG. 3). As the diaphragm 129 moves, it carries with it the attached disc-shaped member 127 and its actuating portion 131. Thus, the movement of the diaphragm 129 causes the latching rollers 102 to move out of the slot 100 in the slide stem 78.

The second actuator mechanism 83 may also be tripped if the nozzle is removed from the fill tank. When the nozzle is inserted in the fill tank, the sealing rim assembly 40 (FIG. 1) is pushed up along the fluid discharge tube toward the main body portion 11. The bellows of the vapor recovery shroud 30 are compressed toward the main body portion 11, and the circular portion 153 of the push rod 152 which is located in the bellows is moved toward the main body portion. The actuating portion 154 of the push rod moves into the vapor chamber 125 (FIG. 5), pushing the slide cam 144 in opposition to the springs 145 and 146, and allowing the cam follower to move toward the cap 133 (FIG. 3). The spring 114 pushes the actuating portion 131 along with the cam follower 130 and the diaphragm 129 toward the cap 133. The spring 114 also pushes the latching rollers 102 into engagement within the slot 100 of the slide stem 78.

If the nozzle is removed from the fill tank with the trigger mechanism 73 still engaged, the second actuator mechanism 83 is tripped to stop the flow of liquid. The removal of the nozzle from the fill tank causes the sealing rim assembly 40 (FIG. 1) to return to its resting position and allows the bellows of the vapor recovery shroud 30 to re-open. The circular portion 153 of the push rod 152 which is in the bellows moves away from the main body portion, and the actuating portion 154 of the push rod moves out of the vapor chamber 125 (FIG. 5). The springs 145 and 146 return the slide cam 144 to its resting position, forcing the cam follower 130 away from the cap 133 and toward the slide stem 78 (toward the right as shown in FIG. 3). The diaphragm 129 which is attached to the cam follower 130 also moves toward the slide stem 78. The movement of the diaphragm 129 has the same effect as if there were excess vapor pressure in the vapor chamber 125, and the latching rollers 102 are moved out of the slot 100 in the slide stem 78.

When the latching rollers 102 are moved out of the slot 100 either by action of the diaphragm 105 or the diaphargm 129, the slide stem 78 is no longer fixed within the guide sleeve 98, and it is free to move within the central opening in the sleeve. The slide stem 78 does not move downwardly by reason of the coil spring 119 which holds the slide stem essentially in place. However, any attempt to activate the trigger mechanism 73 with a force which exceeds that of the spring 119 will pull the slide stem 78 downwardly and compress the spring 119. Thus, if the latching rollers 102 are moved out of the slot 100, an attempt to operate the trigger mechanism 73 will pull the slide stem 78 downwardly. The engaging portion 76 of the trigger mechanism no longer has a fixed pivot point, and it will be unable to force the valve stem 55 inwardly to open the main valve 22. Thus, the main valve 22 closes, and it will remain closed as long as the tripping mechanism is actuated. When both the diaphragm 105 and the diaphragm 129 return to their resting position as shown in FIG. 2, and the coil spring 119 pulls the slide stem 78 upwardly to its resting position, the spring 114 forces the clevis 101 inwardly to return the latching rollers 102 to their position within the slot 100.

There are thus four ways by which flow of fluid through the nozzle 10 may be interrupted: (1) the trigger mechanism 73 can be manually released, allowing the valve stem 55 of the main valve 22 to be pushed downwardly by the spring 68; (2) the fill tank can become filled with liquid, closing the end of the vacuum vent passage 86 and causing the diaphragm 105 to be pulled toward the cap 111 against the spring 114, moving the latching rollers 102 out of the slot 100, and releasing the slide stem 78; (3) the vapor pressure in the vapor recovery line can exceed a predetermined minimum, causing the diaphragm 129 to move away from the cap 133 against the spring 114, and releasing the slide stem 78; or (4) the nozzle can be removed from the fill tank, extending the vapor recovery shroud 30 and the push rod 152, causing the slide cam 144 to push the cam follower 130 and the diaphragm 129 away from the cap 133 against the spring 114, and releasing the slide stem.

To disassemble the nozzle, the seal 123 must be broken. The screw 120 can then be removed to release the spring 119 and permit the slide stem 78 to be removed through the bottom of the main body portion. Once the slide stem 78 has been removed, the trigger mechanism 73 can be moved out of the way, and the assembly of the main valve 22 can be removed through the bottom of the main body portion. Thus, any disassembly of either the tripping mechanism 81 or the main valve 22 requires the removal of the seal 123. The removal of this seal 123 indicates that the nozzle has been repaired or reconstructed and provides ready visual evidence that the nozzle is no longer in factory condition.

While the invention has been shown and described with respect to a particular embodiment thereof, this is for the purpose of illustration rather than limitation, and other variations and modifications of the specific embodiment herein shown and described will be apparent to those skilled in the art, all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. In a valved nozzle for controlling the flow of fluid from a hose to a tank having a fill tube, the nozzle having a main body adapted for connection to the hose, a fluid discharge tube projecting outwardly from the main body for insertion into the fill tube, a fluid passage defined by the main body and located therein for the flow of fluid from the hose to the discharge tube, a trigger located below the main body, a trigger-operated valve mechanism for controlling the flow of fluid through the fluid passage, a shroud assembly surrounding the discharge tube for containing a flow of vapor from the tank when the fluid discharge tube is inserted in the fill tube, and a tripping mechanism located in the main body and connected to the valve mechanism whereby the valve mechanism in inoperative when the tripping mechanism is actuated, the improvement comprising:

a vapor passage defined by the main body and located therein above the fluid passage for the flow of vapor from the shroud assembly to the hose;

sensing means connected to the shroud assembly for sensing displacement of a portion of the shroud assembly with respect to the fluid discharge tube; and actuating means connecting the tripping mechanism to the sensing means for actuating the tripping mechanism when a portion of the shroud assembly is displaced.

2. A valved nozzle as defined in claim 1, wherein the valve mechanism includes a fluid valve located in the fluid passage and actuated by the trigger, the valve being separated from the top of the main body by the vapor passage.

3. A valved nozzle as defined in claim 2, wherein the fluid valve is removable from the main body only in the direction toward the trigger.

4. A valved nozzle as defined in cliam 1, wherein the shroud assembly has a resting position and a displaced position, the shroud assembly being capable of engaging the fill tube to be moved from its resting position to its displaced position when the nozzle is dispensing fluid into the tank, the actuating means actuating the tripping mechanism when the shroud assembly moves from its displaced position toward its resting position.

5. A valved nozzle as defined in claim 4, wherein the valve mechanism is inoperative when the shroud assembly is in its resting position.

6. A valved nozzle as defined in claim 1, wherein the tripping mechanism is accessible through an opening at the top of the main body, the opening adapted to be closed by a permanently installed seal.

7. A valved nozzle as defined in claim 2, wherein the valve mechanism includes an engaging portion pivotally connected at one end to the main body portion, the engaging portion including a cam extending upwardly toward the main body, the cam engaging the stem of the fluid valve.

8. A valved nozzle as defined in claim 1, wherein the tripping mechanism includes a chamber formed in a recess in the main body, the chamber covered by a cap, there being sealing means located between the cap and the main body portion, the cap being held in place by a retaining ring, the sealing means and the retaining ring being located in the same groove in the main body.

9. In a valved nozzle for controlling the flow of fluid from a hose to a tank having a fill tube, the nozzle having a main body adapted for connection to the hose, a fluid discharge tube for connection to the hose, a fluid discharge tube projecting outwardly from the main body for insertion into the fill tube, a fluid passage defined by the main body and located therein for the flow of fluid from the hose to the discharge tube, a trigger located below the main body, a trigger-operated valve mechanism for controlling the flow of fluid through the fluid passage, a tripping mechanism connected to the valve mechanism for making the valve mechanism inoperative when the tripping mechanism is actuated, and a shroud assembly surrounding the discharge tube for containing a flow of vapor from the tank when the fluid discharge tube is inserted in the fill tube, the improvement comprising:

sensing means connected to the shroud assembly for sensing the displacement of a portion of the shroud assembly; and actuating means connecting the tripping mechanism to the sensing means for actuating the tripping mechanism when a portion of the shroud assembly is displaced.

10. A valved nozzle as defined in claim 9, wherein the shroud assembly has a testing position and a displaced position, the shroud assembly being capable of engaging the full tube to be moved from its resting position to its displaced position when the nozzle is dispensing fluid into the tank, the actuating means actuating the tripping mechanism when the shroud assembly moves from its displaced position toward its resting position.

11. A valved nozzle as defined in claim 10, wherein the valve mechanism is inoperative when the shroud assembly is in its resting position.

12. A valved nozzle as defined in claim 9, wherein the main body has a vapor passage located above the fuel passage for the flow of vapor from the shroud assembly to the hose.

13. A valved nozzle as defined in claim 12, wherein the valve mechanism includes a fluid valve located in the fluid passage and actuated by the trigger, the valve being separated from the top of the main body by the vapor passage.

14. A valved nozzle as defined in claim 13, wherein the fluid valve is removable from the main body only in the direction toward the trigger.

15. A valved nozzle as defined in claim 9, wherein the tripping mechanism is accessible through an opening at the top of the main body, the opening adapted to be closed by a permanently installed seal.

16. A valved nozzle as defined in claim 13, wherein the valve mechanism includes an engaging portion pivotally connected at one end to the main body, the engaging portion including a cam extending upwardly toward the main body, the cam engaging the stem of the fluid valve.

17. A valved nozzle as defined in claim 9, wherein the tripping mechanism includes a chamber formed in a recess in the main body portion, the chamber covered by a cap, there being sealing means located between the cap and the main body, the cap being held in place by a retaining ring, the sealing means and the retaining ring being located in the same groove in the main body.

* * * * *

UNITED STATES PATENT AND TRADEMARK OFFICE

CERTIFICATE OF CORRECTION

PATENT NO. : 4,697,624

DATED : October 6, 1987

INVENTOR(S) : Allen M. Bower et al.

It is certified that error appears in the above-identified patent and that said Letters Patent is hereby corrected as shown below:

Column 12, line 1, claim 1, change "in" to --is--.

Column 13, line 9, claim 10, change "testing" to --resting--.

Signed and Sealed this

Twelfth Day of April, 1988

*Attest:*

DONALD J. QUIGG

*Attesting Officer*

*Commissioner of Patents and Trademarks*